US009581055B2

(12) United States Patent
Kandolf et al.

(10) Patent No.: US 9,581,055 B2
(45) Date of Patent: Feb. 28, 2017

(54) METHOD AND APPARATUS FOR WINDING A RETURN SPRING WITH A TWO PIECE ROTOR FOR A CAM PHASER

(71) Applicant: Schaeffler Technologies GmbH & Co. KG, Herzogenaurach (DE)

(72) Inventors: Michael Kandolf, Saint Clair, MI (US); Matthias Kapp, Oak Park, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 114 days.

(21) Appl. No.: 14/459,675

(22) Filed: Aug. 14, 2014

(65) Prior Publication Data

US 2015/0053157 A1 Feb. 26, 2015

Related U.S. Application Data

(60) Provisional application No. 61/868,605, filed on Aug. 22, 2013.

(51) Int. Cl.
*F01L 1/46* (2006.01)
*F01L 1/344* (2006.01)

(52) U.S. Cl.
CPC .... *F01L 1/3442* (2013.01); *F01L 2001/34483* (2013.01); *F01L 2103/00* (2013.01); *Y10T 29/49231* (2015.01)

(58) Field of Classification Search
CPC ..... F01L 2001/34483; F01L 1/3442
USPC ..... 123/90.15, 90.17
See application file for complete search history.

(56) References Cited

U.S. PATENT DOCUMENTS

| | | | | |
|---|---|---|---|---|
| 6,363,896 | B1 | 4/2002 | Speier | |
| 6,805,080 | B2 | 10/2004 | Golovatai-Schmidt et al. | |
| 7,409,935 | B2 | 8/2008 | Lee et al. | |
| 2005/0252468 | A1* | 11/2005 | Tanaka | F01L 1/022 123/90.17 |
| 2010/0031906 | A1* | 2/2010 | Cuatt | F01L 1/3442 123/90.17 |
| 2011/0073055 | A1* | 3/2011 | Kobayashi | F01L 1/3442 123/90.17 |
| 2011/0073056 | A1* | 3/2011 | Kobayashi | F01L 1/3442 123/90.17 |
| 2014/0224200 | A1* | 8/2014 | Luft | F01L 1/3442 123/90.17 |

FOREIGN PATENT DOCUMENTS

| | | | | |
|---|---|---|---|---|
| DE | 102008007561 | A1 * | 8/2009 | F01L 1/3442 |

* cited by examiner

*Primary Examiner* — Jorge Leon, Jr.
(74) *Attorney, Agent, or Firm* — Antun M. Peakovic

(57) ABSTRACT

A camshaft phaser, including: a drive sprocket; a stator; a rotor at least partially rotatable with the stator; a rotor extension fixedly connected to the rotor, having a slot at at least one outer circumferential position; a spring for biasing the rotor relative to the stator, having a first and a second end, the first end secured in the slot in the rotor extension and the second end secured on the stator.

8 Claims, 6 Drawing Sheets

METHOD AND APPARATUS FOR WINDING A RETURN SPRING WITH A TWO PIECE ROTOR FOR A CAM PHASER

TECHNICAL FIELD

Example aspects described herein relate to camshaft phasers for varying the valve timing of an internal combustion engine. More particularly, the disclosed example embodiments relate to an apparatus and method to wind a return spring on a cam phaser with a two piece rotor.

BACKGROUND

Camshafts are used in internal combustion engines in order to actuate gas exchange valves. The camshaft in an internal combustion engine includes a plurality of cams that engage cam followers (i.e. bucket tappets, finger levers or rocker arms). When the camshaft rotates, the cams lift or depress the cam followers which in turn actuate gas exchange valves (intake, exhaust). The position and shape of the cams dictate the opening period and amplitude as well as the opening and closing time of the gas exchange valves.

Camshaft phasers are used to advance or retard the opening or closing period, phasing the camshaft with respect to the crankshaft rotation. Camshaft phasers generally comprise a timing gear, which can be a chain, belt or gear wheel connected in fixed rotation to a crankshaft by a chain, belt or gear drive, respectively, acting as an input to the phaser. The phaser includes an output connection to the camshaft. A phasing input is also provided in the form of a hydraulic, pneumatic or electric drive in order to phase or adjust the output rotation of the camshaft relative to the input rotation of the crankshaft.

Camshaft phasers are generally known in two forms, a piston-type phaser with an axially displaceable piston and a vane-type phaser with vanes that can be acted upon and pivoted in the circumferential direction. With either type, the camshaft phaser is fixedly mounted on the end of a camshaft. An example mounting may be performed as disclosed in U.S. Pat. No. 6,363,896, entitled "Camshaft Adjuster for Internal Combustion Engines", by Wolfgang Speier, issued on Apr. 2, 2002, using a clamping screw forming the element of the camshaft phaser that effects centering relative to the camshaft.

Camshaft phasers that operate according to the vane-cell principle for use on single camshafts are known in the art. U.S. Pat. No. 6,805,080, entitled "Device for changing the control times of gas exchange valves of internal combustion engines, particularly rotary piston adjustment device for rotation angle adjustment of a camshaft relative to a crankshaft", by Eduard Golovatai-Schmidt et al., issued on Oct. 19, 2004, generally shows a construction of a vane-cell type camshaft phaser for use in an internal combustion engine. These single camshaft phasers are commonly used on dual overhead cam (DOHC) engines where intake and exhaust cam lobes are located on separate intake and exhaust camshafts.

It is known to receive oil for chambers in a camshaft phaser, formed by a rotor and a stator for the phaser and used to control phasing of the phaser, in radially aligned channels opening to a radially central space. However, the requirement for a radially central space increases both the radial extent of the phaser and limits the spaces into which the phaser can be installed as well as the options for supplying oil to the chambers. With increasing engine sizes and decreasing space in engine compartments, axial and radial space is becoming limited, sometimes requiring multi-piece phaser assemblies in order to assemble a phaser in position. Commonly-owned co-pending patent application No. 61/824,033 discloses a phaser section including a stator non-rotatably connected to the drive sprocket, a rotor at least partially rotatable with respect to the stator and a rotor extension non-rotatably connected to the rotor, and a plurality of chambers formed by the rotor and the stator; and a rotor nose separately formed from the phaser section and non-rotatably connected to the phaser section, extending past a front side of the phaser section in a first axial direction. The rotor nose and rotor plate or extension are separately assembled and allow for assembly of the cam phaser assembly onto engines with restricted axial and radial space. U.S. patent application No. 61/824,033 is incorporated herein by reference.

U.S. Pat. No. 7,409,935 discloses a method and apparatus for setting a bias or return spring load during assembly of a camshaft phaser. A spring retainer is used with a first end of a bias spring engaged in a notch, the spring wrapped around the spring retainer and secured at a second end by an eccentric bolt or fastener. The spring is wound about the spring retainer and the spring retainer, in turn is secured to the rotor of the cam phaser. Where there is limited axial and radial space, such a separate component, such as a spring retainer can not be utilized. A method and apparatus for attaching and winding the return spring in a multi-piece phaser assembly is needed.

SUMMARY OF THE INVENTION

Certain terminology is used in the following description for convenience and descriptive purposes only, and is not intended to be limiting to the scope of the claims. The terminology includes the words specifically noted, derivatives thereof and words of similar import.

According to example aspects illustrated herein, there is provided a camshaft phaser, including a drive sprocket arranged to receive torque; a stator non-rotatably connected to the drive sprocket, a rotor at least partially rotatable with respect to the stator; a cover plate non-rotatably connected to the stator, having at least a first and a second post at a front face of the cover plate; a rotor plate non-rotatably connected to the rotor, the rotor plate having at least one slot at at least one circumferential position and at least one coupling feature for rotating the rotor plate; a return spring for biasing the rotor within the stator, the return spring having a first end and a second end; the first end of the spring secured into the slot; the second end of the spring secured on the stator; and the spring at least partially wrapped around a circumferential surface of the rotor plate.

According to example aspects illustrated herein, there is provided a method for assembling a return spring to a predetermined torque onto a camshaft phaser assembly, the method comprising the steps of fixing a first end of the return spring to a slot in a rotor extension; fixing a second end of the return spring to a stator; winding the return spring by rotating the rotor extension relative to the second end of the spring; stopping the winding when a pre-determined torque value is reached; and fixing the rotor extension to a rotor nested within the stator.

BRIEF DESCRIPTION OF DRAWINGS

The above mentioned and other features and advantages of the embodiments described herein, and the manner of attaining them, will become apparent and be better understood by reference to the following description of at least one example embodiment in conjunction with the accompanying drawings. A brief description of those drawings now follows.

DETAILED DESCRIPTION OF THE INVENTION

Identically labeled elements appearing in different ones of the figures refer to the same elements but may not be referenced in the description for all figures. The exemplification set out herein illustrates at least one embodiment, in at least one form, and such exemplification is not to be construed as limiting the scope of the claims in any manner. Furthermore, it is understood that this disclosure is not limited to the particular methodology, materials and modifications described and as such may, of course, vary.

Unless defined otherwise, all technical and scientific terms used herein have the same meaning as commonly understood to one of ordinary skill in the art to which this disclosure belongs. It should be understood that any methods, devices or materials similar or equivalent to those described herein can be used in the practice or testing of the disclosure.

Figure 1A:
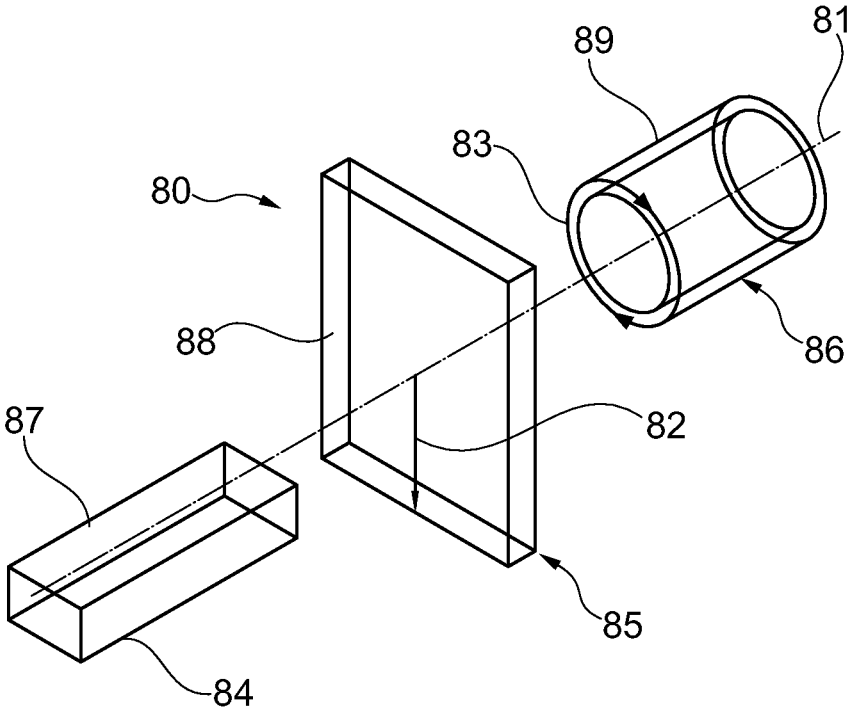
FIG. 1A is a perspective view of a cylindrical coordinate system demonstrating spatial terminology used in the present application.

FIG. 1A is a perspective view of cylindrical coordinate system 80 demonstrating spatial terminology used in the present application. The present disclosure is at least partially described within the context of a cylindrical coordinate system. System 80 has a longitudinal axis 81, used as the reference for the directional and spatial terms that follow. The adjectives "axial," "radial," and "circumferential" are with respect to an orientation parallel to axis 81, radius 82 (which is orthogonal to axis 81), and circumference 83, respectively. The adjectives "axial," "radial" and "circumferential" also are regarding orientation parallel to respective planes. To clarify the disposition of the various planes, objects 84, 85, and 86 are used. Surface 87 of object 84 forms an axial plane. That is, axis 81 forms a line along the surface. Surface 88 of object 85 forms a radial plane. That is, radius 82 forms a line along the surface. Surface 89 of object 86 forms a circumferential plane. That is, circumference 83 forms a line along the surface. As a further example, axial movement or disposition is parallel to axis 81, radial movement or disposition is parallel to radius 82, and circumferential movement or disposition is parallel to circumference 83. Rotation is with respect to axis 81.

The adverbs "axially," "radially," and "circumferentially" are with respect to an orientation parallel to axis 81, radius 82, or circumference 83, respectively. The adverbs "axially," "radially," and "circumferentially" also are regarding orientation parallel to respective planes.

Figure 1B:
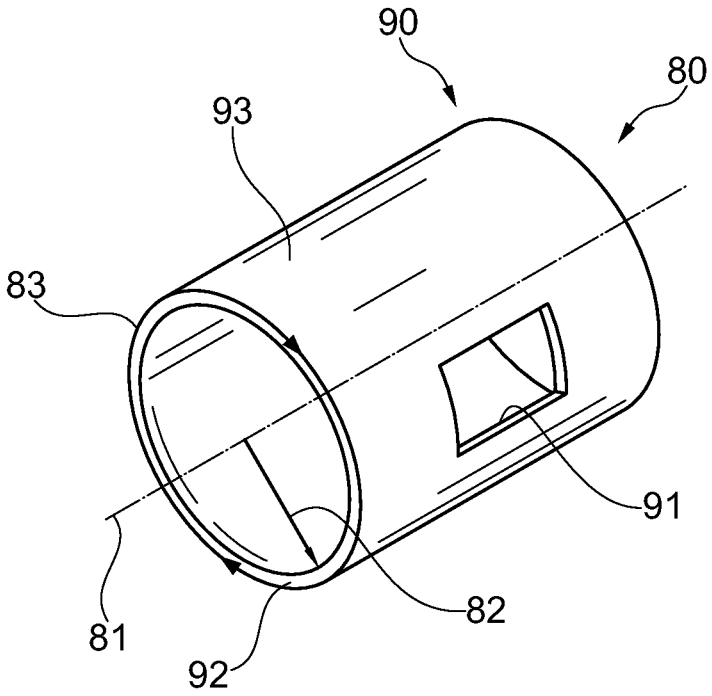
FIG. 1B is a perspective view of an object in the cylindrical coordinate system of FIG. 1A demonstrating spatial terminology used in the present application.

FIG. 1B is a perspective view of object 90 in cylindrical coordinate system 80 of FIG. 1A demonstrating spatial terminology used in the present application. Cylindrical object 90 is representative of a cylindrical object in a cylindrical coordinate system and is not intended to limit the present invention in any manner. Object 90 includes axial surface 91, radial surface 92, and circumferential surface 93. Surface 91 is part of an axial plane, surface 92 is part of a radial plane, and surface 93 is a circumferential surface.

Figure 2:
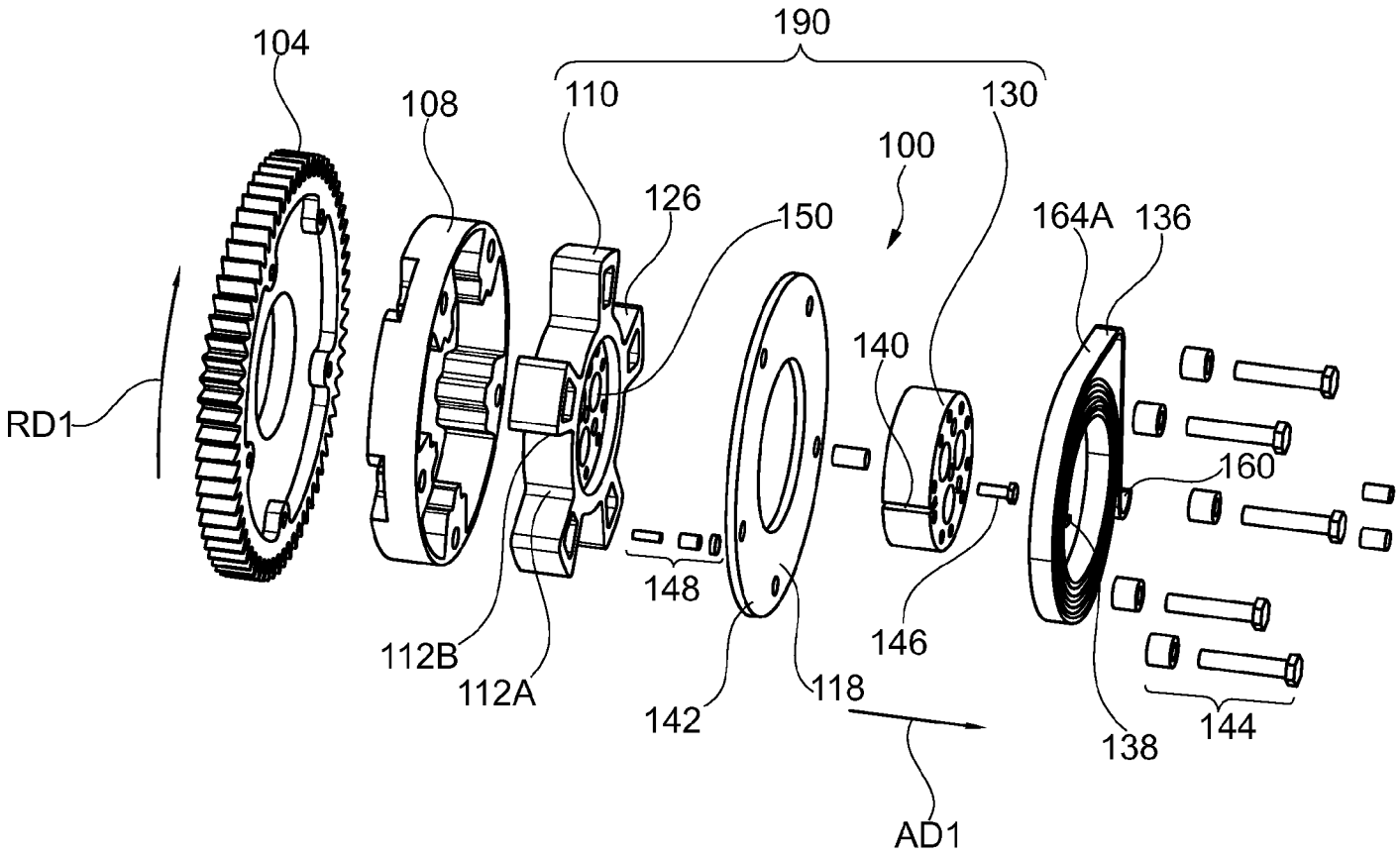
FIG. 2 is a perspective exploded assembly view of a camshaft phaser according to one example embodiment.

FIG. 2 is a perspective exploded assembly view of camshaft phaser 100 according to one example embodiment.

Figure 3:
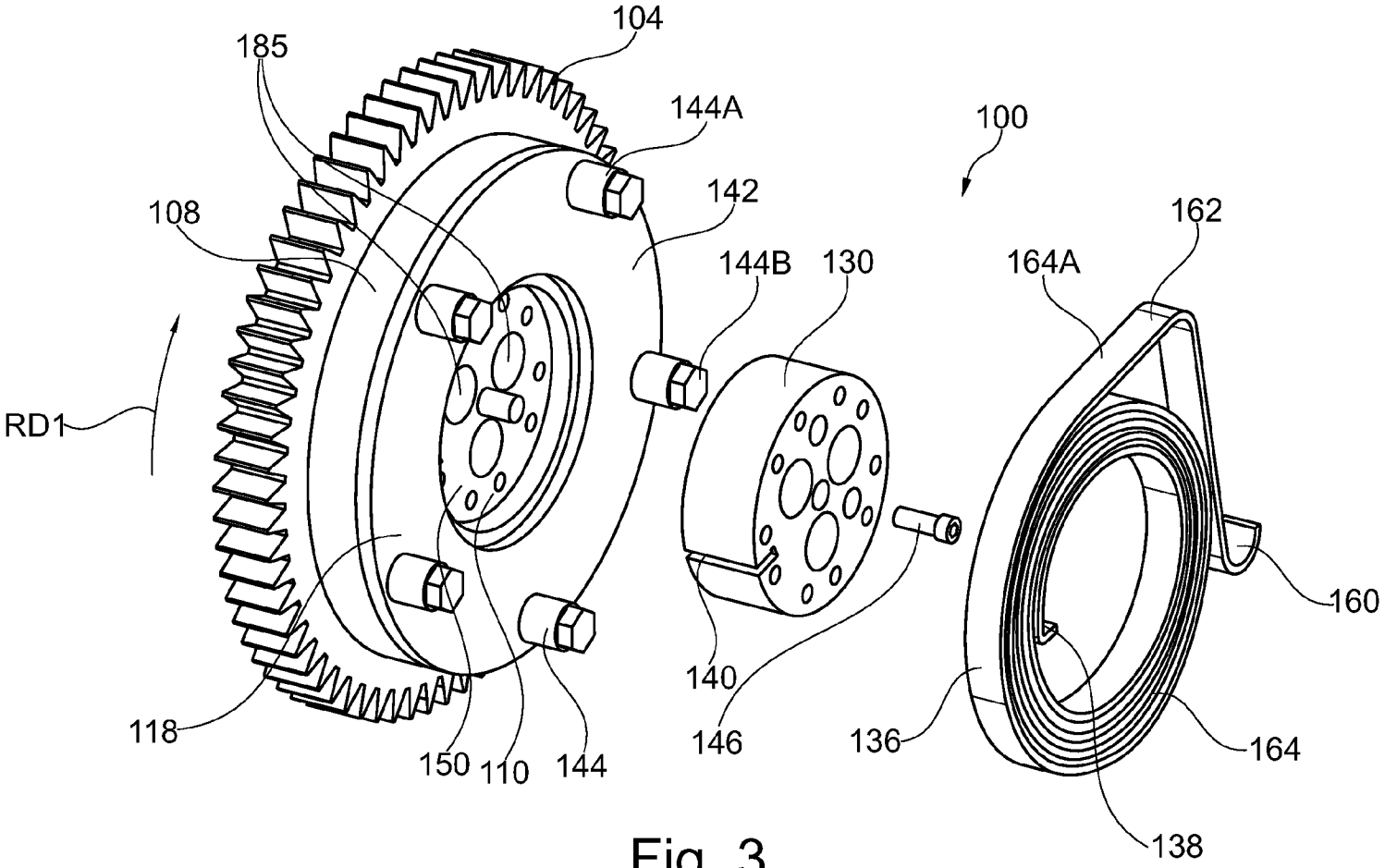
FIG. 3 is a perspective partial exploded assembly view of the camshaft phaser of FIG. 2.

FIG. 3 is a perspective partial exploded assembly view of camshaft phaser 100 of FIG. 2.

Figure 4:
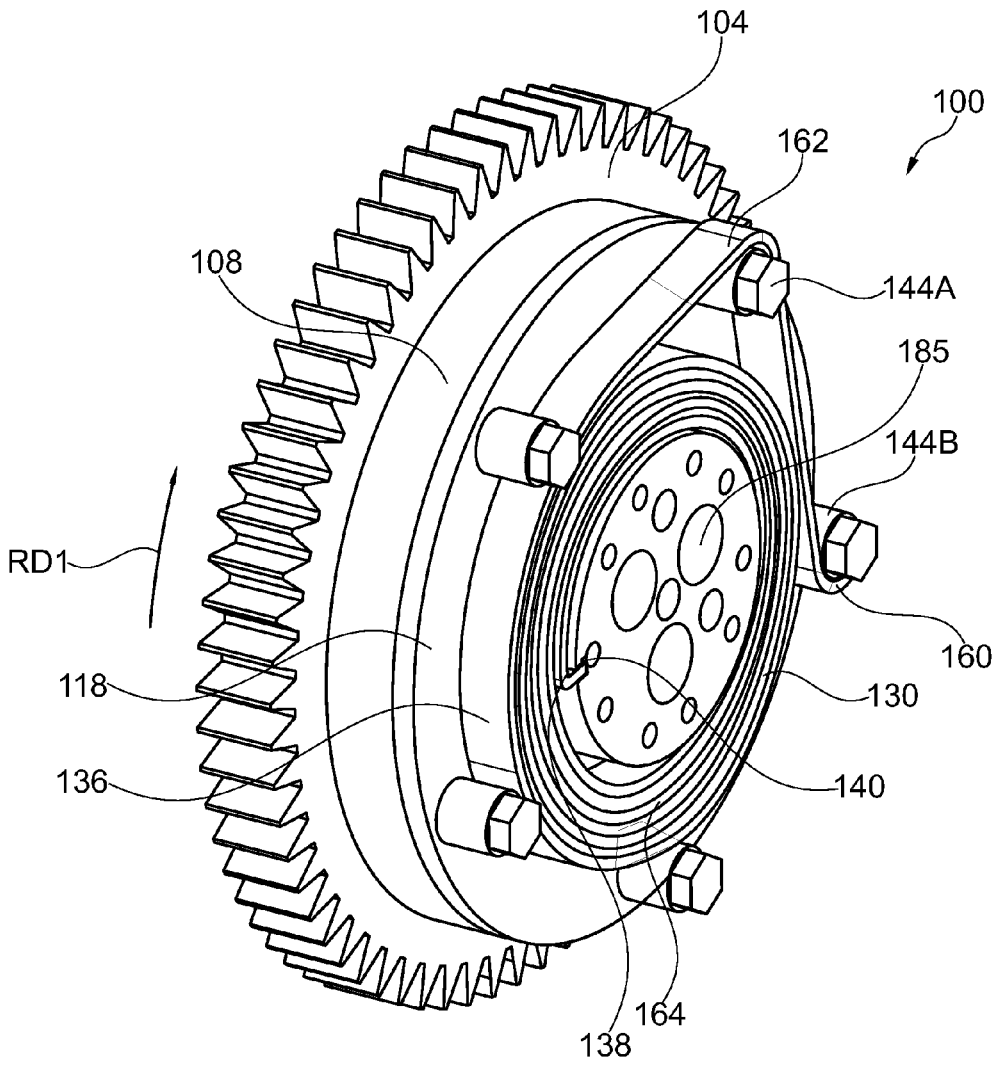
FIG. 4 is a front perspective assembly view of the camshaft phaser of FIG. 2.

FIG. 4 is a front perspective assembly view of the camshaft phaser of FIG. 2.

Figure 5:
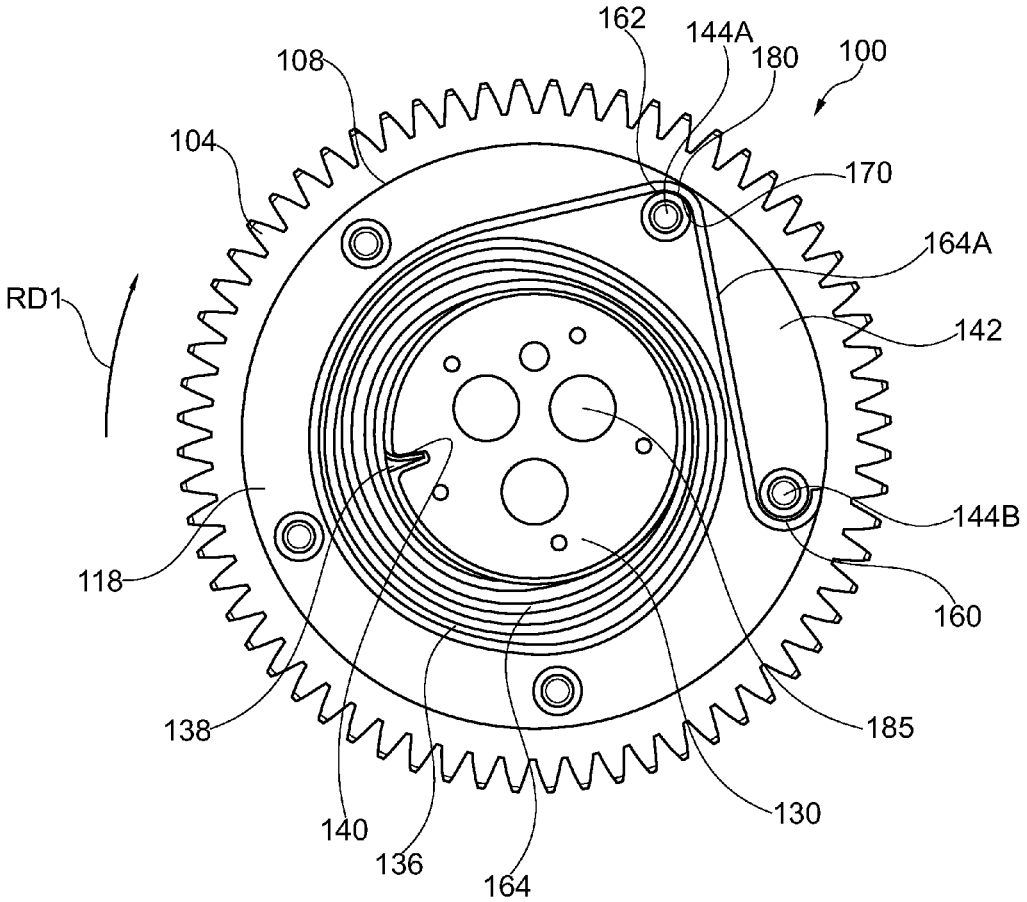
FIG. 5 is a front view of the camshaft phaser of FIG. 2.

FIG. 5 is a front view of the camshaft phaser of FIG. 2. The following description should be viewed in light of FIGS. 2 through 5. Phaser 100 includes drive sprocket 104 arranged to receive torque; stator 108 non-rotatably connected to the drive sprocket; rotor 110 at least partially rotatable with respect to the stator and having radially aligned channels 112; and chambers 116 formed by the rotor and the stator, and open to (fed by) radially aligned channels 112. Rotor 110 includes vanes 126 and rotor plate mounting surface 150 for rotor plate or extension 130 non-rotatably connected to rotor 110. The terms "rotor plate" and "rotor extension" are used interchangeably in the following description.

In an example embodiment, seal plate 142 is used to seal chambers 116. In an example embodiment, bolt/bushing assembly 144 is used to non-rotatably connect plate 142, stator 108 and sprocket 104. Bolts 144 also are used to anchor spring 136. In an example embodiment, fastener/bushing 146 is used to non-rotatably connect plate 130 and rotor 110. In an example embodiment, locking pin assembly 148 is used to lock rotor 110 in a default position as is known in the art. It will be understood by one skilled in the art, that although bolts 144 are used in the present disclosure, any form of suitable fastener can be used.

Referring again to FIGS. 2 through 5, an exemplary method and apparatus is further described. Spring 136 is used to provide a default positioning force for rotor 110. Tab 138 formed at a first end of coil 164 of spring 136 is engaged with slot 140 in extension 130. Spring 136 includes spring coil 164, formed as a flat steel ribbon in this embodiment, wrapped around a circumferential surface of rotor plate 130, in consecutive expanding radial layers in the final assembled state, best shown in FIGS. 4 and 5. Semi circular securing contour 160 is formed at a second end of coil 164, at outer coil 164A of spring 136, and positioned to wrap around a radially outer circumferential surface 181 of securing bolt 144B. Outer coil 164A then extends tangentially from bolt 144B to wrap bolt 144A, an inner surface 170 of coil 164A contacting and wrapping around at least a portion of radially outer circumferential surface 180 of bolt 144A, forming wrap contour 162. In one embodiment, spring 136 is then wound using a tool (not shown) inserted into bolt clearance holes 185, holes 185 provided to allow fasteners (not shown) to extend through phaser 100 and secure phaser 100 to a camshaft of an internal combustion engine (not shown). It will be understood by one skilled in the art that alternate positions and methods of winding can be utilized without changing the scope of the present disclosure, including, but not limited to a single coupling feature on a front axial face of the rotor plate used to rotate the rotor plate. Once spring 136 is wound in consecutive radial layers as shown in FIGS. 4 and 5 and set to a predetermined torque value, as measured, for example, by a torque meter, fastener 146 is used to secure rotor plate 130 to rotor 110 and hold rotor assembly 190 (comprising rotor 110 and rotor plate 130) in a predetermined angular position relative to stator 108. Spring 136 is thus preloaded such that tab 138 urges plate 130 (and hence rotor 110 which is non-rotatably connected to plate 130 using fastener 146 in this embodiment) in rotational direction RD1.

In an alternative embodiment wrap bolt 144A and securing bolt 144B can be replaced by a wrap post and securing post located on an axially front, radially outer surface 118 of cover plate 142 or stator 108, designed for the same function as that described using bolts 144A and 144B.

In the foregoing description, example embodiments are described. The specification and drawings are accordingly to be regarded in an illustrative rather than in a restrictive sense. It will, however, be evident that various modifications and changes may be made thereto, without departing from the broader spirit and scope of the present invention.

In addition, it should be understood that the figures illustrated in the attachments, which highlight the functionality and advantages of the example embodiments, are presented for example purposes only. The architecture or construction of example embodiments described herein is sufficiently flexible and configurable, such that it may be utilized (and navigated) in ways other than that shown in the accompanying figures.

Although example embodiments have been described herein, many additional modifications and variations would be apparent to those skilled in the art. It is therefore to be understood that this invention may be practiced otherwise than as specifically described. Thus, the present example embodiments should be considered in all respects as illustrative and not restrictive.

What is claimed is:

1. A camshaft phaser comprising;

a drive sprocket arranged to receive torque;

a stator non-rotatably connected to the drive sprocket;

a cover plate non-rotatably connected to the stator, having at least a first and a second post at a front portion of the cover plate;

a rotor at least partially rotatable with respect to the stator and cover plate;

a rotor plate having at least one slot at at least one circumferential position and at least one coupling feature for rotating the rotor plate;

a return spring for biasing the rotor within the stator, the return spring having a first end and a second end;

the first end of the spring secured into the slot; and the second end of the spring secured on the first of the posts;

wherein, in a first state the rotor plate is rotatable attached to the rotor and the rotor plate is rotated until the return spring is wound to a first torque value, and in a second state the rotor plate is non-rotatable attached to the rotor after the return spring is wound to the first torque value.

2. The phaser of claim 1, wherein the at least two posts are fasteners used to non-rotatably connect the cover plate to the stator.

3. The phaser of claim 2, wherein the spring extends from the first post around an outer surface of the second post prior to wrapping around the rotor plate.

4. The phaser of claim 1, wherein the coupling feature is comprised of at least two bolt holes for bolts extending through the phaser and securing the phaser to a camshaft of an engine.

5. A method for assembling a return spring to a predetermined torque onto a camshaft phaser assembly, the method comprising the steps of:

fixing a first end of the return spring to a slot in a rotor extension;

fixing a second end of the return spring to a stator;

winding the return spring by rotating the rotor extension relative to the second end of the spring;

stopping the winding when a pre-determined torque value is reached; and fixing the rotor extension to a rotor nested within the stator.

6. The method of claim 5, further comprising a step of correlating number of rotations of the rotor extension to a torque value of the return spring.

7. The method of claim 6, wherein in the step of stopping the winding when a pre-determined torque value is reached, the step includes stopping the winding when the number of rotations of the rotor extension correlating to the torque value of the return spring is reached.

8. The phaser of claim 1, wherein the rotor plate has a substantially circular outer circumference.

* * * * *